US009604123B2

(12) United States Patent
Tolman

(10) Patent No.: US 9,604,123 B2
(45) Date of Patent: Mar. 28, 2017

(54) BUSHING, SKATEBOARD TRUCK AND SKATEBOARD

(71) Applicant: Dorian Tolman, Salt Lake City, UT (US)

(72) Inventor: Dorian Tolman, Salt Lake City, UT (US)

( * ) Notice: Subject to any disclaimer, the term of this patent is extended or adjusted under 35 U.S.C. 154(b) by 0 days.

(21) Appl. No.: 14/495,878

(22) Filed: Sep. 24, 2014

(65) Prior Publication Data

US 2015/0145226 A1 May 28, 2015

Related U.S. Application Data

(60) Provisional application No. 61/960,767, filed on Sep. 26, 2013.

(51) Int. Cl.
*A63C 17/01* (2006.01)

(52) U.S. Cl.
CPC ..... *A63C 17/012* (2013.01); *A63C 17/015* (2013.01); *A63C 17/017* (2013.01); *Y10T 16/05* (2015.01); *Y10T 16/088* (2015.01)

(58) Field of Classification Search
None
See application file for complete search history.

(56) References Cited

U.S. PATENT DOCUMENTS

| | | | | |
|---|---|---|---|---|
| 2,763,490 | A | 9/1956 | Crone | |
| 4,047,725 | A * | 9/1977 | Pinchock | A63C 17/0046 280/11.28 |
| 4,071,256 | A | 1/1978 | Kimmell | |
| 326,261 | A | 9/1985 | Baebows | |
| 5,853,182 | A | 12/1998 | Finkle | |
| 6,428,023 | B2 | 8/2002 | Reyes et al. | |
| 6,523,837 | B2 * | 2/2003 | Kirkland | A63C 17/01 280/11.28 |
| 7,007,957 | B1 * | 3/2006 | Lee | 280/11.28 |
| 7,080,845 | B2 * | 7/2006 | Inchley | 280/87.042 |
| 7,093,842 | B2 * | 8/2006 | Chmelar | 280/87.042 |
| 7,150,460 | B2 * | 12/2006 | Williams | 280/87.042 |
| 7,219,907 | B2 * | 5/2007 | Chang | 280/87.042 |
| 7,316,408 | B2 * | 1/2008 | McClain | 280/87.042 |
| 7,413,200 | B2 | 8/2008 | Horn | |
| 8,210,549 | B1 * | 7/2012 | Swenson | A63C 17/012 280/11.28 |
| 8,783,699 | B2 * | 7/2014 | Gesmer | A63C 17/012 280/87.042 |
| 2002/0011713 | A1 * | 1/2002 | Kirkland | 280/11.28 |
| 2005/0167938 | A1 * | 8/2005 | Chung et al. | 280/87.042 |
| 2006/0097470 | A1 * | 5/2006 | Chmelar | 280/87.042 |
| 2007/0164530 | A1 * | 7/2007 | Horn | 280/87.042 |
| 2010/0327547 | A1 * | 12/2010 | Wilson et al. | 280/87.042 |
| 2011/0148055 | A1 * | 6/2011 | Visinski et al. | 280/11.27 |
| 2011/0210526 | A1 * | 9/2011 | Williams, Jr. | 280/11.28 |

* cited by examiner

*Primary Examiner* — John Walters
*Assistant Examiner* — Hilary L Johns

(57) ABSTRACT

This application provides skateboards and skateboard trucks.

16 Claims, 8 Drawing Sheets

BUSHING, SKATEBOARD TRUCK AND SKATEBOARD

This Application claims the benefit of U.S. Provisional Patent Application No. 61/960,676, filed Sep. 24, 2013, which is herein incorporated by reference in its entirety.

FIELD OF THE INVENTION

The invention is generally related to skateboard trucks and skateboards having trucks.

BACKGROUND OF THE INVENTION

The traditional/original skateboard truck is basically a roller skate assembly from an individual skate split in half and attached to the bottom of a piece of wood (e.g., skateboard deck). Many alternatives to traditional skateboard trucks have been made in the fifty years since the invention of the traditional skateboard truck. The design, geometry, and components of modern skateboard trucks have improved since the first skateboard trucks were invented but the basic mechanism, design and principles of operation are still the same as those original trucks.

Skateboard trucks have several components which are held together by a kingpin including a hanger, a baseplate, and one or more bushings. The hanger has an axle to which the skateboard wheels (and bearings) are attached; the baseplate is the component that is used to attach the truck to the deck. The bushings have a cylindrical hole through the center that accommodates the kingpin and are typically cylindrical in form (cone, barrel, or stepped).

An important component of skateboard trucks is the bushings which are made of an elastic material. Typical skateboard bushings are cylindrical in nature and have a cylindrical passage in the center through which the kingpin passes. Common bushings that are cylindrical in nature are cone bushings, barrel bushings, and stepped bushings. Generally speaking there are two bushings per truck and four per board. The type and hardness of the bushing effects turning, stability, and shock absorption. Nowadays aftermarket elastic bushings are available for skateboard trucks that differ in their hardness (e.g., different durometer). For the sake of continuity, the elastic member in this patent application that corresponds to standard skateboard truck bushings will also be referred to as bushings in the trucks described herein.

The bushing(s), hanger and baseplate are held together in traditional trucks by a bolt called the kingpin. Because the bolt in this patent application also performs the function of holding the components of the truck together, the bolt is also called the kingpin or single supporting kingpin.

Traditional skateboard and longboard trucks also have another component commonly called the pivot cup. The pivot cup is usually made of a semi-hard elastic material which sits in a seat or housing in the baseplate of the truck forming the component called the pivot. Because the location of the locking pivot in the truck of the invention is located in roughly the same position, performs a similar function, it is described herein using a similar name to that in the traditional truck. It is noted though that the mechanics and geometry of the locking pivot of the truck described herein offers distinct advantages to the typical pivot, including unexpectedly excellent riding characteristics.

The hanger of a typical truck has a corresponding male piece which sits inside the pivot cup seat, or housing, forming one end of the pivot axis. The other end of the pivot axis is the seat of the hanger resting on the baseplate side bushing of the skateboard. The angle at which the pivot axis lies in relation baseplate (or deck) determines the pivot axis of the skateboard and in combination with the length of the pivot axis determines the lean to steer ratio property.

At the time of writing this application, virtually the only skateboard trucks available for street skating are very similar to the ones being used in the 70s. Most of the longboard trucks available are very similar to those in street skating and even use many of the same components.

These traditional skateboard trucks are by far the most used skateboard trucks and could be viewed as the only trucks being used, because alternatives to these traditional products are seen as "fringe products" (or experimental), have not gained popularity, or shown commercial success.

Another type of truck is used for off-road skateboarding and typically uses fixed axis trucks.

Many of the alternative trucks that have been made over the years use a design where the hanger pivots around a bolt or a pin to create the pivot axis.

The problem with many of these bolt or pin pivot axis designs is that they offer very little shock absorption. This is usually because the bolt or pin is fixed in the base plate and the hanger and all of the contact points of the parts are hard contact (metal on metal) leaving little or no shock absorption capability.

Shock absorption in both long boarding and street skating is extremely critical and there is a need to have a truck that offers greater shock absorption, since the sport involves a lot of jumping and landing on the board, sometimes from large heights. There is also a need for good shock absorption in longboarding that would improve traction. Additionally, by absorbing vibration from the road, the trucks described herein help maintain traction much like a cars suspension system and transfer less "road" vibration to the rider.

BRIEF SUMMARY OF THE INVENTION

Provided herein is a skateboard truck with remarkable improvements over currently available trucks including turning radius, shock absorption and stability.

Accordingly, provided herein is a truck having the following basic components configured to work together to provide an exceptionally excellent performing truck: a baseplate, a hangar, a kingpin and a non-circular bushing where the hanger and baseplate have housings for the non-circular bushing. The baseplate of the truck is mounted on the underside of a skateboard with fasteners according to any appropriate manner and in some specific configurations are attached via the conventional industry standard method (e.g., hardware and spacing). The hanger is attached to the baseplate via a single supporting kingpin which is threaded or passes through the non-circular bushing. The hanger and baseplate are designed to accommodate the non-circular bushing, each having a partial housing for the bushing. The non-circular bushing refers to a bushing made of an elastic material (similar to that of conventional bushing) having a hole through the center of it that allows for, or accommodates, the kingpin. The supporting kingpin is tightened adequately to hold the components in place as described herein. The axis of the hanger which the hanger rotates allows the truck to steer. The pivot angle or the angle at which the hanger rotates is determined by the angle at which the kingpin lies in relation to the deck or baseplate plane.

Provided herein also are skateboards, both regular skateboards and longboards, that have the trucks described herein, optionally fitted with wheels, bearings, and/or other components.

BRIEF DESCRIPTION OF THE DRAWINGS

The following description can be better understood in light of the Figures, in which.

Figure 1:
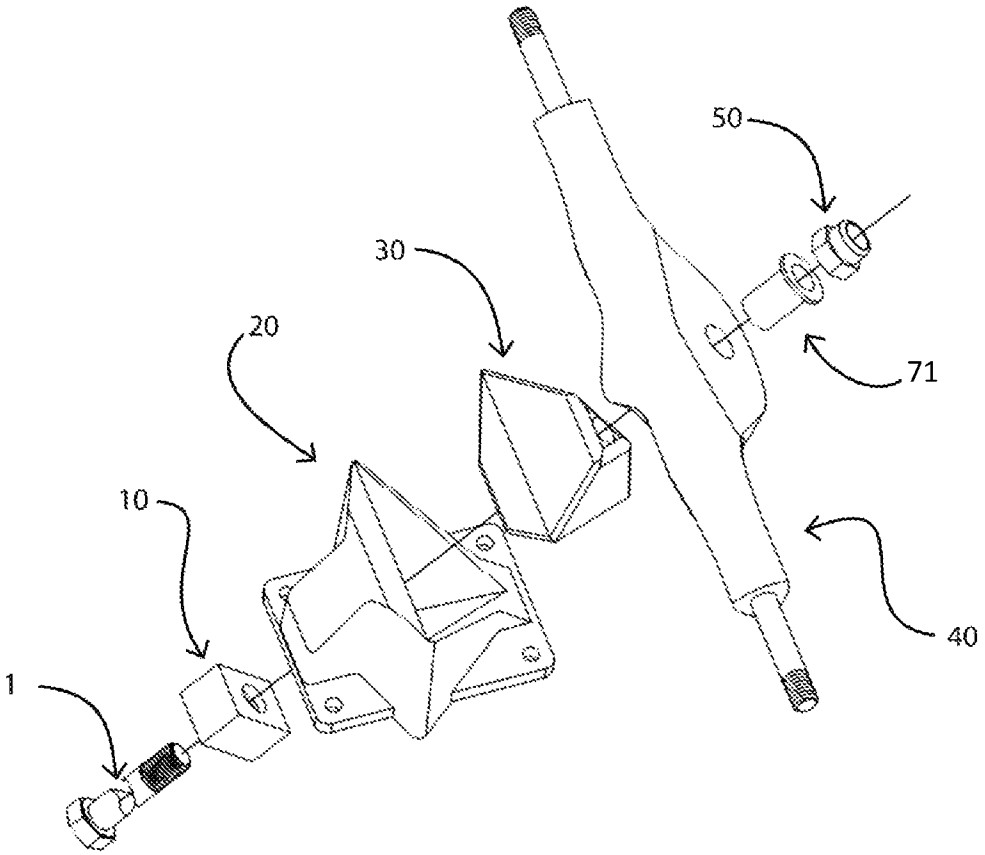
FIG. 1 shows a view of one embodiment of a skateboard truck as described herein.

The Figures illustrate specific aspects of the trucks and skateboards provided herein. Together with the following description, the Figures demonstrate and explain the principles of the trucks and skateboards. In the drawings, the thickness of layers and regions are exaggerated for clarity. The views of the trucks and skateboards are not drawn to scale or have the indicated proportions. The same reference numerals in different drawings represent the same element, and thus their descriptions will not be repeated. As the terms "on", "attached to", or "coupled to" are used herein, one object (e.g., a material, a layer, a substrate, etc.) can be on, attached to, or coupled to another object regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

DETAILED DESCRIPTION OF THE INVENTION

The following description supplies specific details in order to provide a thorough understanding of the skateboards and trucks described herein. Nevertheless, the skilled artisan would understand that the skateboards and trucks and associated methods of making and using such can be implemented and used without employing these specific details. Indeed, the skateboards and trucks, and associated methods can be placed into practice by modifying the illustrated devices and methods and can be used in conjunction with any other materials (e.g., plastic or aluminum) and techniques conventionally used in the industry. For example, while the description refers to skateboards and in particular aspects skateboard trucks, it could be modified to be used with other vehicles besides skateboards.

The following description is included to illustrate concepts and particular embodiments related to the invention. As will be appreciated by those of skill in the art, the techniques, methods and compositions disclosed in the following examples are representative of particular modes for practice of the invention while not being intended to limit scope of the invention.

The location of the parts described herein is generally in the same location as a traditional skateboard truck and are referred to similarly where appropriate. As described in this application, a skateboard truck comprising a baseplate, a hanger, a kingpin and a non-circular bushing wherein the baseplate and hanger have partial housings for the non-circular bushing is provided. Furthermore, a skateboard comprising two skateboard trucks as described herein and a skateboard deck is provided. The skateboard trucks and skateboard having the trucks can also include skateboard wheels and/or bearings or other components.

The inventor has manufactured are number of trucks and skateboards having the trucks in a manner consistent with the description given herein and found that the truck and skateboard having the trucks have unexpectedly excellent performance characteristics in comparison to traditional skateboard trucks.

As used herein, the term "non-circular bushing" refers to a component made of an elastic material that is designed to serve a similar function as traditional skateboard bushings and dictate to a certain extent the feel of the skateboard or ride. The non-circular bushing as described herein has a hole through the center and is capable of accommodating the kingpin whose shaft passes through the hole in the bushing. In this context, the term non-circular refers to the geometric shape of outside portion (or surface) of the bushing that comes into contact (or is juxtaposed to) with the hanger or baseplate; this outside portion of the bushing is not circular e.g., not circular in a plane perpendicular to the axis of the kingpin, the outside portion of the bushing is not circular. Thus, non-circular, as used herein, specifically excludes currently available skateboard bushings such as cone bushings, barrel bushings, and stepped bushings.

The truck described herein is designed to operate in a manner similar to that of the common truck used today in existing skateboards. Steering is usually activated by the rider leaning (e.g., typically by shifting weight towards one side of the board or the other).

In one embodiment, a truck is provided comprising: (a) a baseplate for attaching the truck to a skateboard comprising a non-circular partial housing for a non-circular bushing and a housing for a pivot; (b) a hangar comprising a non-circular partial housing for a non-circular bushing and an axle having ends that wheels can be affixed to; (c) a pivot which fits in the housing for the pivot in the baseplate and has a hole which the kingpin passes through; (d) a non-circular bushing, a portion of which fits in the non-circular partial housing of the baseplate and a portion of which fits in the non-circular partial housing of the hangar and has a hole through which a kingpin passes through; and (e) a kingpin that fits in the hole through the non-circular bushing and serves to attach the hangar to the baseplate. In one aspect, the truck has a baseplate with a non-circular partial housing for a non-circular bushing that is of a shape for partially housing a bushing having the shape of a polyhedron. In one aspect, the truck has a baseplate with a non-circular partial housing for a non-circular bushing that is of a shape for partially housing a bushing having the shape of a truncated bipyramid. In one aspect, the baseplate has a housing for a pivot wherein the pivot has a shape of a cube or a rectangular cuboid and a cylindrical hole for housing the kingpin. In one aspect, the truck has a hangar with a non-circular partial housing for a non-circular bushing that is of a shape for partially housing a bushing having the shape of a polyhedron. In one aspect, the truck has a hangar with a non-circular partial housing for a non-circular bushing that is of a shape for partially housing a bushing having the shape of a truncated bipyramid. In one aspect, the truck has a non-circular bushing in the shape of a polyhedron. In one aspect, the truck has a non-circular bushing in the shape of a truncated bipyramid. In one aspect, the truck has a pivot having a cylindrical hole through which the kingpin fits. In one aspect, the pivot is made of a semi-rigid elastic polymer. In one aspect, the non-circular bushing having a shape of a polyhedron having 2 or more filleted edges. In one aspect, the kingpin and the corresponding features of the hangar and the baseplate are configured so that the axis of the kingpin is at an acute angle to the baseplate and a perpendicular angle to the axle of the hanger. In one aspect, the non-circular bushing made of a polyurethane elastomer. In one aspect, the truck has a pivot locker. In one aspect, the angle of the axis of the kingpin to the baseplate is an acute angle or is less than 80 degrees.

As shown and described herein, the outside surface of the non-circular bushing is in contact with, adjacent to, or juxtaposed to a partial housing of the hanger for the bushing and/or a partial housing of the baseplate for the bushing. In some embodiments, the amount of surface area of the bushing that is enclosed in the partial housings when the truck is assembled is greater than 40%, 50%, 55%, 60%, 65%, or 70%.

In another embodiment, a skateboard is providing having 2 trucks as described in the paragraph above. In one aspect. The trucks are affixed to the skateboard such that the mouths of the acute angles mentioned above (formed by the kingpin and the plane of the baseplate) face each other. For example, using the greater than and less than symbols to illustrate the acute angles the configuration is < >.

In another embodiment, a non-circular bushing for a truck is provided having a housing for a non-circular bushing wherein the non-circular bushing has (a) two or more faces that come into contact with two or more faces of a partial bushing housing of the hanger and (b) two or more faces that come into contact with two or more faces of the partial baseplate housing of a truck. In one aspect, the non-circular bushing has the shape of a polyhedron. In one aspect, the non-circular bushing has the shape of a truncated bipyramid. In one aspect, the non-circular bushing has the shape of a truncated triangular bipyramid. In one aspect, the non-circular bushing has the shape of a polyhedron and the polyhedron has two or more filleted edges. In one aspect, the non-circular bushing has the shape of a truncated triangular bipyramid having two or more filleted edges. In one aspect, the non-circular bushing made of a polyurethane elastomer.

It should be noted that in some embodiments, the bushing is not completely enclosed within the corresponding housing formed by partial housings of the hanger and baseplate.

A more detailed description of the parts of these embodiments is described below in reference to the figures.

Description of the Bushing (30)

Figure 2:
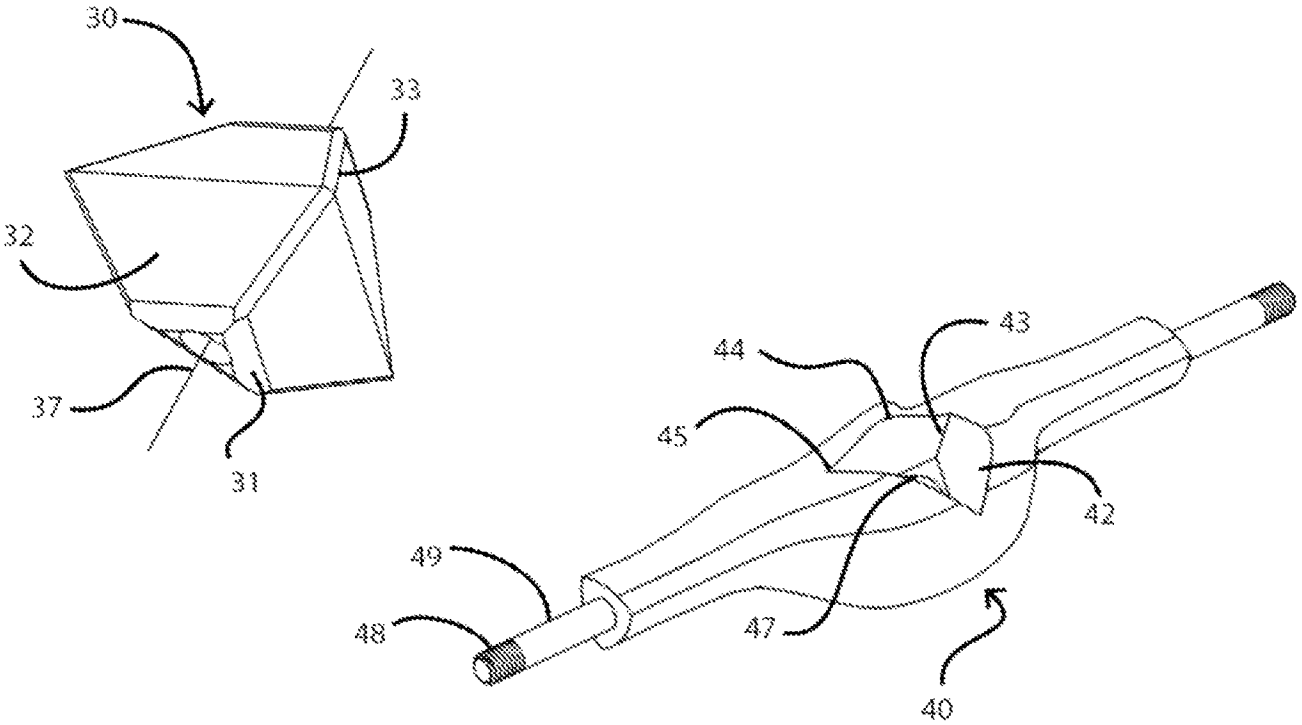
FIG. 2 shows a view of one embodiment of the hanger and bushing as described herein.
Figure 4:
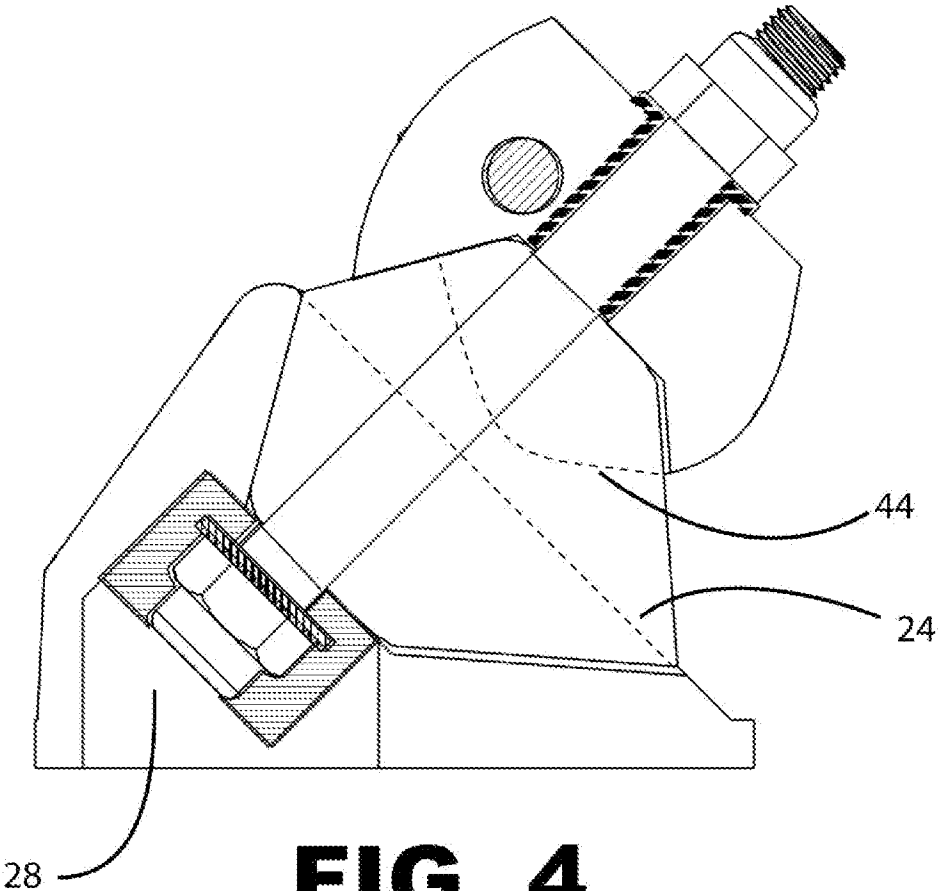
FIG. 4 shows a bisected view of one embodiment of the truck assembly as described herein.
Figure 6:
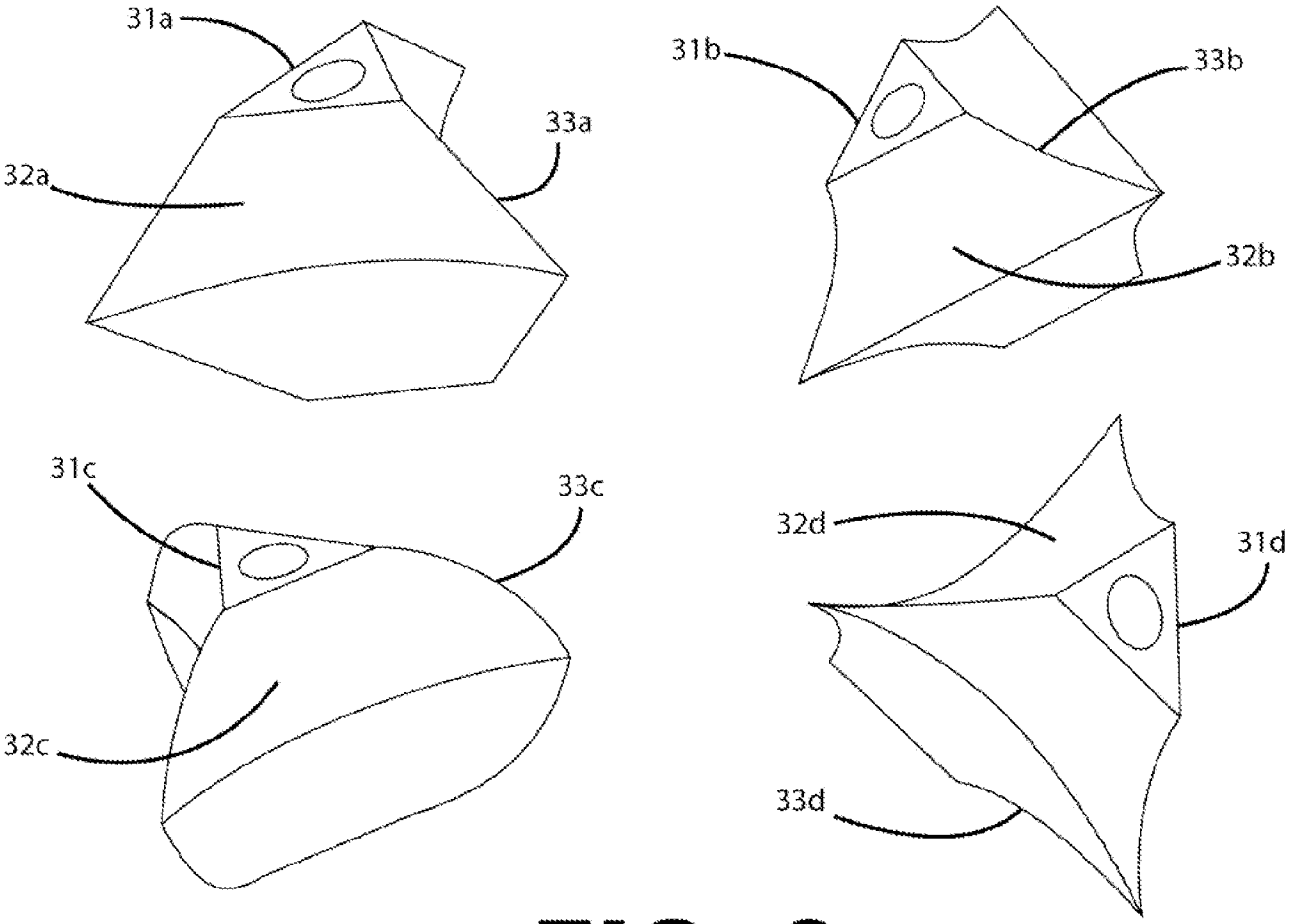
FIG. 6 shows a view of embodiments of the bushing as described herein.
Figure 7:
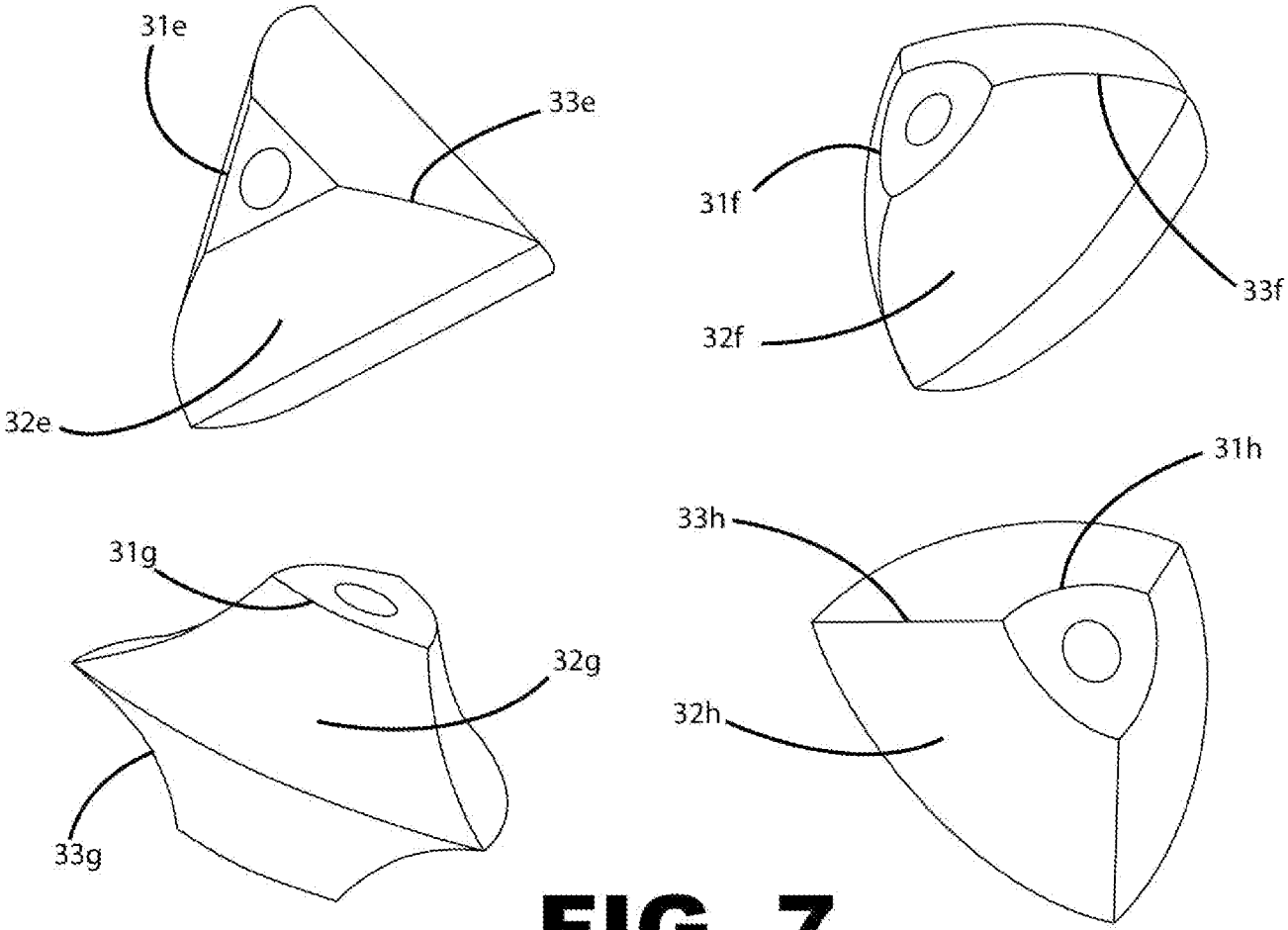
FIG. 7 shows a view of embodiments of the bushing as described herein.

The bushing (in some embodiments) of the skateboard truck (30) is shown in FIGS. 1, 2, and 4. Additional bushing designs are shown in FIGS. 6 and 7. It is noted that combination of features from the various bushing shown in the figures may be combined to arrive at or generate a bushing within the scope of the invention, but not specifically illustrated. The general shape shown in those figures is that of a truncated triangular bipyramid. Generally speaking, the bushing's outside surface is not circular in nature like the commercially available standard skateboard bushings (e.g., cone, barrel or stepped bushings). In reference to FIG. 1, the bushing (30) in one aspect, generally has the shape of a truncated triangular bipyramid polyhedron (e.g., hexahedron) where the tetrahedrons on either side of the mirror plane are truncated below the vertex in a plane, the truncated vertices having a hole (37) (e.g., cylindrical) going through the center of the bushing perpendicular to the minor plane for the kingpin (1). The bushing can also be another non-circular shape (typically a polyhedron or dual thereof) as long as it has a hole (e.g., cylindrical) for accommodating the kingpin and is geometrically compatible with its respective parts on the hanger and baseplate. For example, the bushing can have the shape of pentagonal bipyramid, a hexagonal bipyramid, or an octahedron. Preferable, the polyhedron shape has two planes which are co-planar and perpendicular to the axis of the kingpin and impart the truncated character to the bipyramid. In one specific aspect of the bushings described in this paragraph, the bushing is not in the shape of a regular cube or a rectangular parallelepiped. The shapes of the faces and edges of the bushing are not necessarily linear. For example the faces and edges can have convex or concave edges, faces, or both (31*a-h*)(32*a-h*)(33*a-h*). Additionally, while the general shape described herein is an important feature, the bushing can be modified to include appendages or have portions removed while retaining or improving the performance characteristics of the truck. Any such modifications, may or may not have corresponding modifications on other parts of the truck.

The bushing (30) is made of a highly durable elastic compound, e.g., elastomer. Polyurethane elastomers are the most common material for use in skateboard truck bushings and can be the material used for the bushings described herein. In one aspect, the bushing has a hardness of between about 50 to 100 Shore durometer A. In one aspect, some or all of the edges of the bushing are filleted (31)(33) (31*a-h*)(33*a-h*) as shown in FIGS. 2, 6 and 7. In one aspects, some or all of the edges of the bushing are rounded. The faces (e.g., six faces in a truncated triangular bipyramid) (32)(32*a-h*) have edges (33)(33*a-h*) that can be filleted (or rounded) so that when the bushing in deformed when turning, the bushing can easily return to its resting position. Non-filleted edges for some shapes of the bushing (e.g., triangular bipyramid) may grip the matting edges in the baseplate (23) (FIG. 3) and hanger (43) (FIG. 2), thus impeding the truck from returning to its resting position after a turn is initiated. Filleted edges (31)(33) (FIG. 2) can also ensure that the bushing fits properly into the baseplate (20) and hanger (40) (FIG. 1). The filleted edges can also ensure that the faces of the bushing, baseplate and hanger (22)(32)(42) are properly contacting each other.

The bushing has faces and geometry that impart superior handling and/or mechanical properties as compared to standard circular bushings (e.g., cone, barrel, and stepped bushings).

In one aspect, two or more, three or more, four or more, five or more, six or more, or all of the faces (32) of the bushing are symmetrical to each other. In one aspect, two or more, three or more, four or more, five or more, six or more, or all of the faces (32) of the bushing have a trapezoidal surface area. The faces are angled for a number of reasons. The faces of the bushings are at an angle so that when the trucks are tightened by turning the nut (50) or the bolt (1) shown in FIG. 1 to move the nut further down the threads on the bolt; when this is done the pressure on the bushing builds up causing greater resistance in the bushing to turning (or increases the torque required to turn). This resistance in a turning position is created by the bushing trying to return to its unbound position (non-turning position). Because the faces of the hanger lie at such an angle that the bushing is exerting a repelling force on the hanger, it requires an increase in force to get the trucks to turn e.g., so that when the truck is turned and the mated faces (22)(32)(42) are sliding relative to each other they can more easily slide and allow the bushing to rest in the proper position. Filleted edges also help the faces of the bushing to line back up properly (e.g., when not deformed by turning).

In one specific aspect, the bushing described herein has dimensions within the ranges (including the endpoint) given below:

- each edge of plane forming the base of the two pyramids constituting the bipyramid—2.0 to 3.0 inches;
- each edge forming junction between two faces (faces (32))—0.75 inches to 1.5 inches;
- each edge forming truncated portion of pyramid (shortest side of face)—0.75 inches to 1.5 inches;
- height as measured from truncated plane to truncated plane 1.0 inches to 2.25 inches.

The dimensions given is this paragraph do not take into account any removal of length or height due to filleting (or convexity or concavity). For example, the edge of plane forming the base of the two pyramids constituting the bipyramid is specified to be within the range 2.0 to 3.0 inches (including 2.0 and 3.0 inches); in the case that the bushing has filleting of edge (33) the removes 0.1 inches of actually length of that edge to yield and actual physical length of 1.95 inches this dimension is considered to fall within the range since 1.95 inches plus 0.1 inches gives 2.05 inches. In a specific aspect, the bushing is of the shape of a truncated triangular bipyramid.

In another specific aspect, the bushing described herein has dimensions within the ranges (including the endpoint) given below:

- each edge of plane forming the base of the two pyramids constituting the bipyramid—2.125 to 2.75 inches;
- each edge forming junction between two faces (faces (32))—1.0 inches to 1.5 inches;
- each edge forming truncated portion of pyramid (shortest side of face)—0.75 inches to 1.25 inches;
- height as measured from truncated plane to truncated plane 1.25 inches to 2.0 inches.

The dimensions given is this paragraph do not take into account any removal of length or height due to filleting as described in the paragraph above (or convexity or concavity). In a specific aspect, the bushing is of the shape of a truncated triangular bipyramid.

In yet another specific aspect, the bushing described herein has dimensions within the ranges (including the endpoint) given below:

- each edge of plane forming the base of the two pyramids constituting the bipyramid—2.25 to 2.75 inches;
- each edge forming junction between two faces (faces (32))—1.125 inches to 1.5 inches;
- each edge forming truncated portion of pyramid (shortest side of face)—0.875 inches to 1.25 inches;
- height as measured from truncated plane to truncated plane 1.375 inches to 1.875 inches.

The dimensions given is this paragraph do not take into account any removal of length or height due to filleting as described in the paragraph above (or convexity or concavity). In a specific aspect, the bushing is of the shape of a truncated triangular bipyramid.

The specific dimensions given in the paragraphs above give rise to or specify the shapes (and/or dimensions) of the corresponding housings for the bushing in the baseplate and hanger taking into account the descriptions of features of those housing described elsewhere in this application. The skilled artisan recognizes that the edges and faces of the bushing can be curvilinear.

It is noted that the housings for the bushing (e.g., partial housing of the hanger and partial housing of the baseplate) do not necessarily completely contain the bushing—that is to say that when the truck is assembled, there are portions of the bushing that can be exposed. In one aspect, the housings for the bushing do not completely contain the bushing—that is to say that when the truck is assembled, there are portions of the bushing that are exposed.

Description of the Pivot (10)

Figure 3:
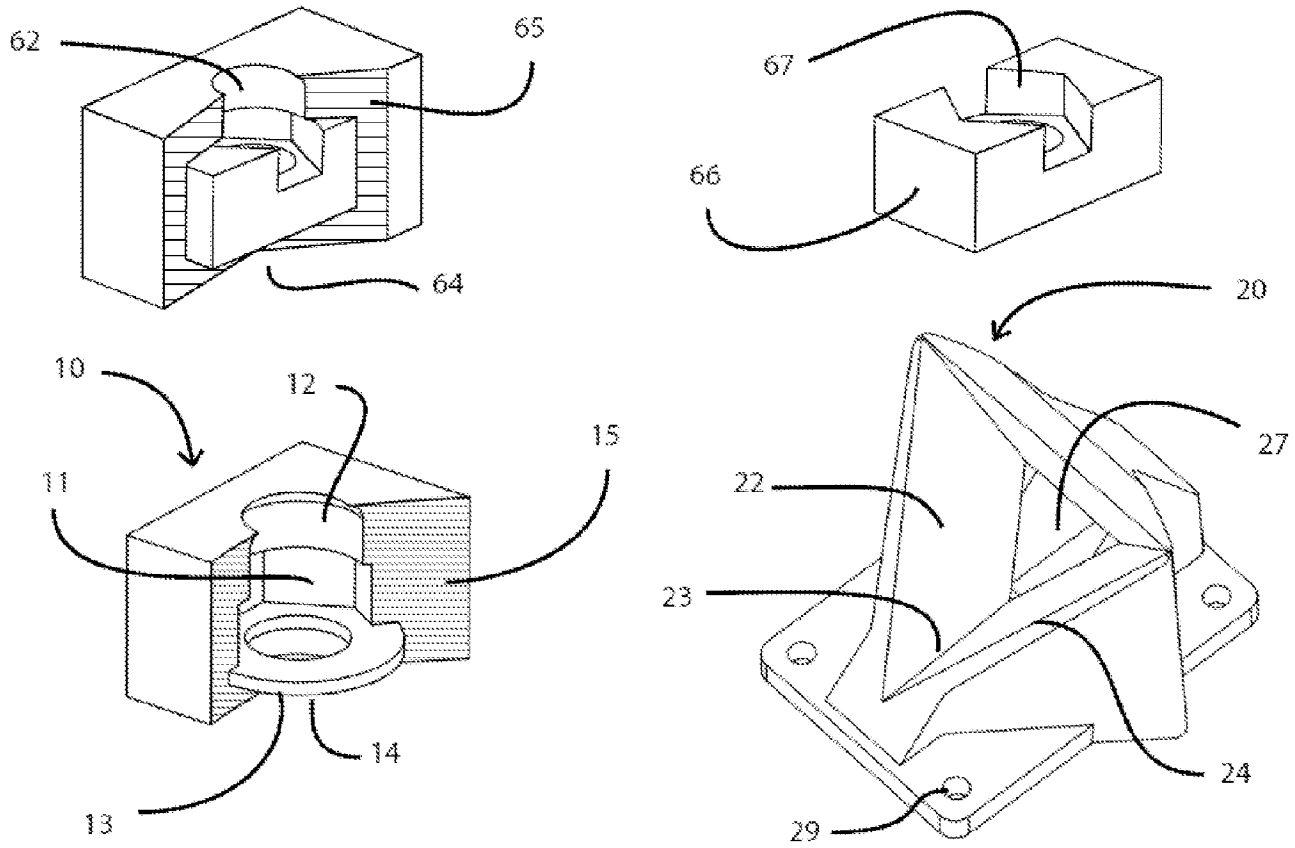
FIG. 3 shows an exploded view of two embodiments of the locking pivot/baseplate of the truck e.g., a locking pivot and a locking pivot with a nut trap.
Figure 8:
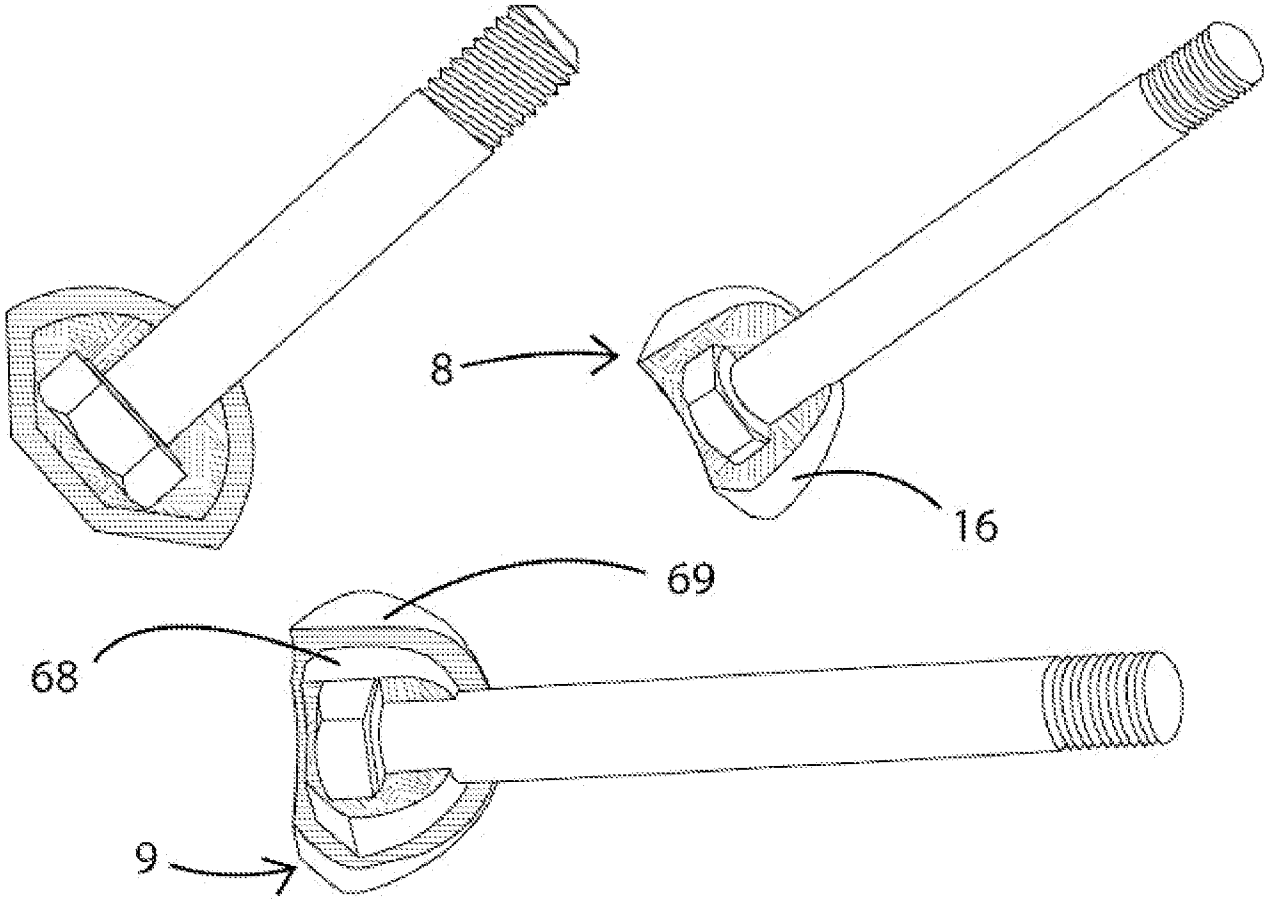
FIG. 8 shows a view of an embodiment of the pivot as described herein

The part known as the pivot (10), FIGS. 1, 3, and 8 may be configured in any number of ways, several of which are described herein. Components (or features) (62), (64), (65), (66) and (67) of FIG. 3 illustrate part of one particular configuration or design. Pivot design (10) having components (or features) (11), (12), (13), (14) and (65) of FIG. 3 illustrate part of another particular configuration or design. Pivot design (9) having components (or features) (68), (69), and (81) of FIG. 8 illustrate part of another particular configuration or design. Pivot design (8) having components (or features) (16) and (80), of FIG. 8 illustrate part of another particular configuration or design. As described herein, regardless of the specific pivot configuration, the pivot resides in or is part of the baseplate unit of the truck.

The pivot performs several functions which are common to the designs shown herein. In some aspects the pivot body (15) (or (10)(9)) can be made of a semi-rigid elastic durable polyurethane having a hardness of about 90 to 100 Shore durometer A (or e.g., 90 to 60d). The material from which the pivot body is made, in some aspects, has a hardness range to be both flexible enough for the kingpin to have some ability to move and provide shock absorption, yet hard enough to hold the bolt or nut in place to allow the trucks to be tightened. In another aspect the contacting surface may be semispherical to improve kingpin freedom (9)(69). Furthermore, this part can: (a) hold the head of the bolt or in the reverse assembly to hold the nut in place; and (b) to make ensure that the nut can move up the threads of the bolt. This function is performed by having complementary faces to the nut or bolt head being used (11). A second function of the pivot is to hold the kingpin (1) in place for maintaining the pivot axis by anchoring the kingpin into the baseplate. The hole (14) should be larger than the actual size of the kingpin (1) so as to allow the bolt to pivot from the center point of the washer (13) allowing the bushing to provide shock absorption without the kingpin shaft (1) coming in contact with the pivot locker kingpin shaft channel (14) which can reduce the absorption desired from bushing (20). Having kingpin shaft channel (14) larger than the kingpin also makes for easier assembly in the reverse assembly as it helps the threads of the kingpin get to the nut (50) without the pivot body getting in the way.

The pivot locker allows the bushing to perform well by allowing the kingpin to move somewhat freely. The bushing, in some aspects, holds the kingpin in place and provides shock absorption.

In one aspect, the washer (13) can be cast into locking pivot (10) to help distribute the force of kingpin over a wider area of the pivot.

Hole (12) is to allow the extra threads of the kingpin to pass through the pivot in the reverse assembly configuration.

Pivot nut trap (66)(68) can be made from any suitable material including but not limited to, aluminum, steel, polyurethane, nylon, epoxy, and epoxy composite. Accommodation of kingpin (or nut in reverse assembly) can be achieved by machining or by casting around kingpin (or nut in reverse assembly) (80) and (81) as shown in FIG. 8. And may be cast or set in the pivot body in a similar fashion (65)(9) (FIG. 3) and FIG. 8. The pivot nut trap functions to hold the head of the bolt or the nut in the reverse assembly. The pivot nut can allow for the tightening or loosening of the truck by holding the nut or head of the kingpin in a fixed position using matching faces (67). Matching faces can be achieved through machining or by casting pivot around kingpin or nut as shown (80) and (81) FIG. 8. Another purpose of the pivot nut trap is to spread the pressure created from tightening the truck assembly over a larger area.

The pivot can also be made in of one piece of a rigid material. Being made of steel, aluminum, brass, plastic, and plastic composite. For the kingpin to still be able to articulate the load bearing side of the pivot must be semi spherical. So that the pivot can articulate like a joint. Inclusion of the kingpin (or nut in reverse assembly) can be achieved by machining or by casting around kingpin (or nut in reverse assembly) (80) and (81). Locking pivot seat (28) should have complementing curvature to accommodate this design.

As described herein, the skateboard truck has a component referred to as the pivot. The pivot of the instant truck is designed and operates in a manner different than the pivot of a traditional skateboard truck. Furthermore, the location and mechanics of the pivot in the truck is different than that of a traditional skateboard truck. The exceptional performance and characteristics of the instant truck are at least in part due to the pivot. Although several configurations of the pivot are shown and described herein, the ordinary skilled artisan in view of the instant description understands that other configurations of the pivot can provided similar truck characteristics that incorporate similar design features such as location and interaction with the other components of the truck. Thus, several characteristics provided by the pivot described herein include in some configurations, but are not limited to, anchoring of the kingpin and having a location within the baseplate. The pivot described herein, in some aspects, allows for play in the kingpin position or allow have a range of motion, which contrasts to that of the standard truck kingpin which is often fixed anchored or fixed to the baseplate by metal to metal contact points of the kingpin and baseplate. Accordingly, the pivot described herein encompasses different shapes and sizes, different means of securing the kingpin e.g., the head of the bolt in some aspects, or the nut that is attached to the kingpin of the bolt. Furthermore, additional designs are contemplated that use different pivot materials or materials of different hardness or different mechanical means of securing the nut or head of the kingpin bolt. The pivot described herein also allows the bushing to operate properly and provide exception performance characteristics.

In some embodiments, it is contemplated that the truck described herein has two pivots a top and bottom pivot e.g., one in the baseplate and one in the hanger. A single pivot as described throughout most of this application is preferred.

In a specific aspect, the pivot body (e.g., piece (15) or (10)) described herein has dimensions within the ranges (including the endpoint) given below:

height—0.25 to 1.25 inches;
width 0.25 inches to 1.5 inches;
length—0.25 inches to 1.25 inches.

In another specific aspect, the pivot body (e.g., piece (15) or (10)) described herein has dimensions within the ranges (including the endpoint) given below:

height—0.5 to 1.25 inches;
width—0.5 inches to 1.5 inches;
length—0.25 inches to 1.0 inches.

In yet another specific aspect, the pivot body (e.g., piece (15) or (10)) described herein has dimensions within the ranges (including the endpoint) given below:

height—0.5 to 1.0 inches;
width—0.5 inches to 1.0 inches;
length—0.5 inches to 1.0 inches.

The specific dimensions given in the paragraphs above give rise to or specify the shapes (and/or dimensions) of the corresponding housing for the pivot body (e.g., piece (15) or (10) (8) and (69)) in the baseplate taking into account the descriptions of features of those housing described elsewhere in this application.

Description of the Hanger (40) Put Path for Kingpin (47) that Holds Part Flanged Bearing (51). The hanger and the axle (49) can be either cast in as a single shaft for both wheels to sit on or as individual axles machined and fitted into the hanger body as shown in FIG. 2. Hanger faces (42) are the mating surfaces for the bushing faces (32) (32*a-h*) and should come in contact with each other over a substantial portion of their respective surface areas. Bearing shaft on axle (49) has threads for a nut(s) (48) to hold on wheels (73).

Hanger seat contour/profile (44) is designed to both insure proper return to center (e.g., the axle can return to the resting position that is level with the skateboard riding platform or deck) and provide a sufficient amount of resistance at the top of the rotation and/or to limit the total amount rotation to prevent wheel bite.

The section of the hanger seat profile (44) (in FIG. 2 there are 3 edges that form the entire profile) that comes closest to the baseplate in the middle of the bushing faces (32) (32*a-h*) is the section of the hanger limits the total amount of rotation the hanger can achieve. Making this pointed section of the profile wider or closer to the baseplate profile (24) (FIG. 3) can cause an increase in resistance with less degrees of rotation (e.g., causes the resistance to increase sooner through the rotation). While moving the point of the hanger seat profile (44) further back and making it narrower relative to the bushing face increases the total degrees of rotation of the hanger relative to the base plate. The three edges that form the hanger seat profile are not necessarily linear and it some aspects, there is a lip or protrusion in the profile of the edge that provides additional improvements in performance (e.g., this would be specifically be located at the position where the line points to (44) in FIG. 2).

The section of the hanger seat profile (45) can adjust the total resistance through the rotation and at the beginning of the rotation of the hanger. Moving the edge of the face of (45) closer to the baseplate increases the resistance to rotation. And moving face (45) further from the baseplate decreases the resistance to rotation.

Having a hanger seat profile (45) closer to the baseplate can be desirable for a skateboarder achieving high speed since when you reach speeds of 40 mph+the truck can utilize only e.g., 1-2 degrees of rotation. Having higher resistance (or a resistance closer to that of a rotation position between 5-10 degrees of hanger rotation) from the resting position could help provide desired stability in the skateboard but does not cause the resistance in the range of 5-15 degrees of rotation to drastically increase. The ramping up of resistance in some aspects controlled o modulated by the shape of contour/profile (44).

Conversely a rider who is more concerned with getting the board to slide and turn more quickly would want the profile (44) to be closer to the baseplate. Part of what helps riders slide a skateboard is the resistance building up in the bushing causing an imbalance of the distribution of force across the wheels which then causes the board to lose traction while the skateboarder is sliding to cause the board to regain traction the rider puts less steering pressure on the skateboard, causing a more even distribution of force across the wheels helping the board to gain traction again. Having the resistance effect is not necessary but can help a rider make it easier to achieve a slide because the rider can over steer the board and decrease the overall traction more easily.

The bearings that are attached to the wheels of the skateboard slide over the axles of the hanger (49) and are held on by a nut using threads (48) this nut can or should be self-locking to ensure that the wheel stays properly fastened. The axles of the hanger described herein in some aspects, have dimensions that are compatible with standard or commercially available skateboard wheel bearings, wheels, or both. In other aspects, the axles are designed to accommodate bearings, wheels, or both, that are not standard or commercially available.

The hanger described herein does not necessarily have edges that are linear. For example edges (e.g., exterior or interior) can be rounded or have curvature or other types of deviations from linearity.

Description of the Baseplate (20)

Baseplate bushing seat profile (24) is the edge of the bushing seat and the defining edge (e.g., depending on how high or low this edge above the dividing wall (27) or pivot ((10) or (15)(8)(9)) for how much surface contact exists on the bushing face (32). The seat profile (24) can be linear (as shown in FIG. 3 or FIG. 4) or curved or have and angle in it (e.g., a portion of 24 may be parallel to the plane of the baseplate that mates with the bottom of the skateboard and another portion which is at an acute angle to the plane of the of the plane of the baseplate that mates to the bottom of the skateboard). The locking pivot seat (28) is designed to anchor the pivot into the baseplate (FIG. 4). FIG. 4 does not necessarily indicate the actually shape and design of the hanger, baseplate and/or bushing but is included to illustrate non-limiting orientations of the kingpin, bushing, baseplate, and pivot (the dashed lines represent areas of the baseplate and hanger that are shown though in this illustration where the hanger or baseplate obstructs the direct view of the bushing). In the drawings (FIG. 4) the bushing and the pivot are in contact. In some aspects, there can be a dividing wall (27) (not shown in FIG. 3 but would be present in the bottom of the partial bushing housing of the baseplate) between the bushing and the pivot with a large hole for at least accommodating the kingpin shaft. In some aspects, it is important that the kingpin never actually contacts the base plate (20) directly as this can cause undesirable direct transfer of force from the hanger to the kingpin into the baseplate which can damage the baseplate and limit shock absorption. Baseplate hardware holes (29) can be configured in a manner similar to that of existing products as an industry standard so all skateboard decks and baseplates are compatible with each other but other configurations may be used.

The three faces (22) of the baseplate should be similar to faces (32) (32*a-h*) of the bushing so that they can be in contact over a substantial portion (e.g., greater than 50%, 55%, 60%, 65%, or 70% or more) of their surface areas. The edges of the bushing seat in the baseplate (23) are preferably sharp but can also be filleted. Regardless, they do not necessarily come into contact with the bushing edges (33) (33*a-h*) because it can be more important that the bushing faces (32) (32*a-h*) are fully seated in the baseplate bushing seat and fully contacting the baseplate bushing seat faces (22).

It is noted that the baseplate of the truck can be configured or designed to geometries or dimensions that vary from those shown in the Figures or described elsewhere to modify characteristics of the truck but provided similar functions described herein. More specifically, the dimensions and geometries of the faces, edges, profiles, holes e.g., (22), (23), (24) may be varied to ensure optimal performance and interaction with other components such as the bushing, kingpin, hanger, pivot, or combination thereof. Furthermore, although the presence of the pivot in the baseplate is important, its exact location, size, material, presence or absence of dividing wall (27) can be varied according while still achieving the same general function and characteristics described herein.

The baseplate described herein does not necessarily have edges that are linear. For example edges (e.g., exterior or interior) can be rounded or have curvature or other types of deviations from linearity.

Description of the Sleeve

Skateboard hanger (40), in some aspects, has what is referred to as a machine flange bushing (51) that can be fitted into hole in the hanger that accommodates the kingpin (FIG. 1) and is made of self-lubricating material, e.g., bronze or any material harder than that of the material of the hanger. This part is a point at which the hanger rotates about. Over time the abuses of skateboarding can wear this hole, causing the axis that the hanger rotates about to become less defined potentially making the truck less stable and controllable. When this part becomes worn, it can be relatively easily replaced with a new identical part. This truck does not necessarily require this part however in some aspects, it improves performance and longevity of the entire truck by allowing a part that takes significant abuse to be replaced. The use of a self-lubricating material, in some aspects, requires less maintenance and improves performance.

Description of the Skateboard

Figure 5:
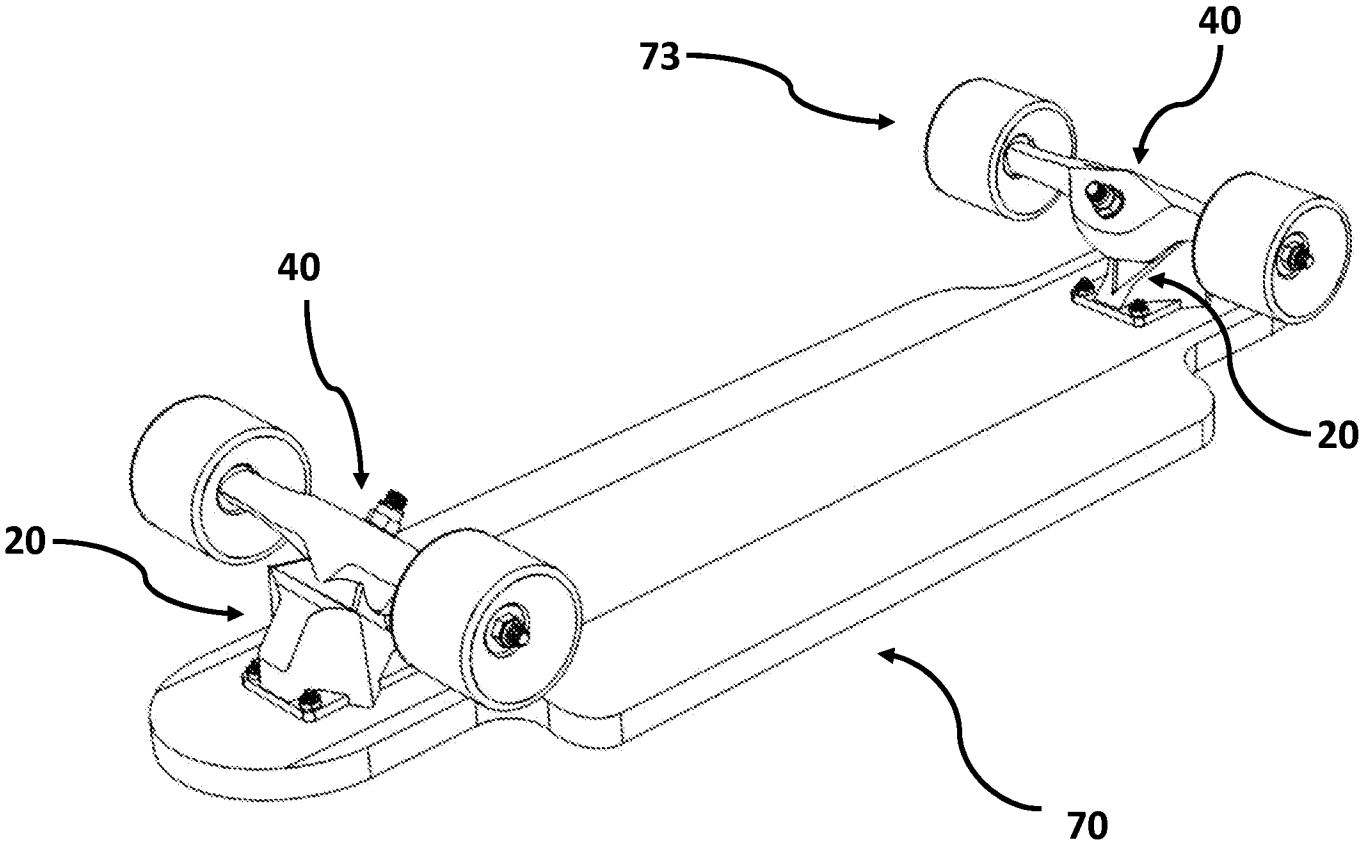
FIG. 5 shows a view of one embodiment of a skateboard having trucks as described herein.

A skateboard having the trucks as described herein is shown in FIG. 5. A skateboard deck (70) which can be any skateboard deck including a deck for street riding, a deck for ramp riding, a deck for park riding, a longboard deck, or any other skateboard deck is shown in FIG. 5. The dimensions, shape, or material from which the deck is made can be any of those used for skateboarding. Skateboard wheels (73) are shown which are attached or affixed to the hanger unit as described herein (40). The skateboard wheels typical are attached or affixed to the truck with the use of bearings. The baseplate (20) is also shown. As described herein elsewhere the dimensions and shape of the individual parts of the truck described herein can be adjusted or varied depending by one of ordinary skill in the art to ensure that they are compatible with particular skateboard decks (street, park, ramp, longboard, etc.), riding styles (e.g., street, ramp, downhill, park, etc.). In some embodiments, component of a complete skateboard are used that are commercially available e.g., wheels, bearings, decks, etc. In other embodiments, the components of a complete skateboard are designed and manufactured to be compatible with non-standard or commercially available shape, sizes and dimension of a truck as described herein.

Generally speaking, the materials used for manufacturing the various components of the skate board truck can be any suitable material, although preferably the materials are similar to that used for construction of traditional skateboard trucks.

Although the bushing and associated steering system are described herein in reference to skateboarding, similar principles can be applied to other devices such as roller skates that utilize similar principles of operation. Thus, the bushing described herein is readily adaptable for use in roller skates although the specific dimensions would be altered (e.g., likely smaller in a roller skate system). It is contemplated, that the hanger and baseplate portions in a roller skate system would be altered or different than that described for the skateboard herein. These modifications of the skateboard design to convert it to a roller skate design are within the purvey of the ordinary skilled artisan in view of the disclosure herein and may or may not include other components or design features (e.g., pivot, or baseplate/hanger configurations).

Additional Embodiments

The bushing and/or housing(s) for the bushing described herein can be used in applications outside of skateboards and skateboard trucks. The follow description relates to embodiments of the bushing and/or housing(s) described herein for these uses.

As described herein, in one embodiment, the bushing is non-circular. In specific aspects, the bushing has the shape of a polyhedron. In another aspect, the bushing has the shape of a bipyramid. In other aspects, the bushing has the shape of a truncated bipyramid. In another aspect, the bushing has the shape of a truncated triangular bipyramid. In one aspect, the shape of the bushing octahedral, truncated octahedral, pentagonal bipyramid, truncated pentagonal bipyramid, tetrahedral, truncated tetrahedral. In one specific aspect of the bushings described in this paragraph, the bushing is not in the shape of a regular cube or a rectangular parallelepiped.

The bushing, in one aspect, generally has the shape of a truncated triangular bipyramid polyhedron (e.g., hexahedron) where the tetrahedrons on either side of the mirror plane are truncated below the vertex in a plane. In some aspects, the truncated vertices having a hole (cylindrical) going through the center of the bushing perpendicular to the mirror plane to accommodate a pin, bolt or other hardware. The bushing can also be another non-circular shape (typically a polyhedron or dual thereof) and may optionally have a hole (e.g., cylindrical) for accommodating the pin, bolt or other hardware. In some aspects, the bushing is geometrically compatible with its respective part(s) or housing(s) that form the remainder of the device, vehicle, or unit in which it is employed. For example, the bushing can be configured (e.g., size, shape, material from which it is made, etc.) to be employed in a vehicle, instrument, machine, device, etc. The vehicle, instrument, machine, or device in these aspects, include parts that are compatible with the bushing and allow for it to operate properly. For example, there may be one or more housings for the bushing to allow for the bushing to perform and/or accomplish its function properly. Examples of functions include damping, shock absorption, reduction in wear and/or tear of other parts, rebound (e.g., analogous to the ability of the bushing to deform upon turning of the skateboard truck, offering resistance as the turn increases and then rebounding to a normal non-turning position). Other functions can include, but are not limited to, noise reduction or attenuation, lubrication elimination, isolation, or vibration reduction or isolation.

The bushing can be used for a machine, device, or vehicle for any use. One specific use is for steering purposes e.g., as part of the steering mechanism. Examples of machines in which the bushing may be used for, include, but are not limited to, ATVs, cars, trucks, heavy machinery, tractors, lawn mowers, or riding mowers. In one aspect, the device or vehicle is a scooter or a wheel chair. In one aspect, the device or vehicle is one which has lean activated steering.

In one aspect, the bushing is used for steering or aiding in the steering mechanism of a vehicle (e.g., steering rack bushing or steering bushing)

The bushing can be made from an elastomer. Elastomers, include, but are not limited to polyurethane, natural rubber, silicone, Viton®, fluroelastomers, fluorosilicone, neoprene, EPDM, nitrile, Hypalon®, butyl or SBR.

Thus, the bushing described herein can be used as a substitute for any bushing used in industries using bushings through adaptation of the teachings of this application. It is noted that the non-circular shape of the bushing is retained in these other uses and designs but the other components can be substantial different (e.g., hanger, baseplate, and/or pivot) or not present in the device. In some specific aspects, the partial housing for bushing are present in the device although the components of the device that have those housing (e.g., the hanger and baseplate) are substantial different than those described herein. In other specific aspects, the device has a component that corresponds to the pivot described herein. In some specific aspects, the pushing has a pin or bolt that that is accommodated in a hole (e.g., cylindrical) that is present in the bushing.

In one specific aspect, the bushing described herein in these additional embodiments has dimensions within the ranges (including the endpoint) given below:

- each edge of plane forming the base of the two pyramids constituting the bipyramid—2.0 to 30 inches;
- each edge forming junction between two faces (e.g., corresponding to faces (32))—0.75 inches to 15 inches;
- each edge forming truncated portion of pyramid (shortest side of face)—0.75 inches to 15 inches;
- height as measured from truncated plane to truncated plane 1.0 inches to 20 inches.

The dimensions given is this paragraph do not take into account any removal of length or height due to filleting. For example, the edge of plane forming the base of the two pyramids constituting the bipyramid is specified to be within the range 2.0 to 3.0 inches (including 2.0 and 3.0 inches); in the case that the bushing has filleting of edge (33) the removes 0.1 inches of actually length of that edge to yield and actual physical length of 1.95 inches this dimension is considered to fall within the range since 1.95 inches plus 0.1 inches gives 2.05 inches. In a specific aspect, the bushing is of the shape of a truncated triangular bipyramid.

In another specific aspect, the bushing described herein in these additional embodiments has dimensions within the ranges (including the endpoint) given below:

- each edge of plane forming the base of the two pyramids constituting the bipyramid—0.2 to 2.75 inches;
- each edge forming junction between two faces (e.g., corresponding to faces (32))—0.1 inches to 1.5 inches;
- each edge forming truncated portion of pyramid (shortest side of face)—0.1 inches to 1.25 inches;
- height as measured from truncated plane to truncated plane 0.1 inches to 2.0 inches.

The dimensions given is this paragraph do not take into account any removal of length or height due to filleting as described in the paragraph above. In a specific aspect, the bushing is of the shape of a truncated triangular bipyramid.

In yet another specific aspect, the bushing described herein in these additional embodiments has dimensions within the ranges (including the endpoint) given below:

- each edge of plane forming the base of the two pyramids constituting the bipyramid—1 to 10 inches;
- each edge forming junction between two faces (e.g., corresponding to faces (32))—0.25 to 10 inches;
- each edge forming truncated portion of pyramid (shortest side of face)—0.25 to 10 inches;
- height as measured from truncated plane to truncated plane 0.25 inches to 15 inches.

The dimensions given is this paragraph do not take into account any removal of length or height due to filleting as described in the paragraph above. In a specific aspect, the bushing is of the shape of a truncated triangular bipyramid.

The specific dimensions given in the paragraphs above give rise to or specify the shapes (and/or dimensions) of the corresponding housings for the bushing in the baseplate and hanger taking into account the descriptions of features of those housing described elsewhere in this application.

It is noted that the housings for the bushing (e.g., partial housing of the hanger and partial housing of the baseplate) do not necessarily completely contain the bushing—that is to say that when the truck is assembled, there are portions of the bushing that can be exposed. In one aspect, the housings for the bushing do not completely contain the bushing—that is to say that when the truck is assembled, there are portions of the bushing that are exposed.

It some of the additional embodiments, the bushing is configured to operate with no pivot, one pivot or two pivots.

The truck is more easily assembled/disassembled than most existing products on the market today. The truck described herein in some aspects has four parts that need to be handled for assembly/disassembly assuming the baseplate is mounted to a deck. The truck can be tightened (e.g., kingpin) to just past full contact to give the truck some static preload. When riding, the dynamics of riding (performance) can be modulated by the bushing. In some aspects, the pivot does not inhibit the bushing in anyway but rather holds the truck together. The bushing gives the truck exceptional shock and vibration absorption. Some trucks (e.g., standard) may not have good absorption because the truck is rotating about a bolt. But because the bolt is held in place by the elastic bushing as described herein the forces are dissipated. Additionally because the hanger is rotating about the kingpin it's steering can be very aggressive. Meaning that when the rider puts input into the truck to turn, the truck responds rapidly. However the steering can also be forgiving because as the truck is loaded by the forces generated by the rider for steering (e.g., leaning or shifting weight) the board-side-baseplate-side of the busing is deforming, causing understeer. This can help the rider more easily achieve maximum traction (however the understeer effect will become more pronounced at speed because the load will produce a consistent amount of degrees understeer). Additionally the combination of aggressive turn initiation and understeer, when loaded, are useful for controlling traction allowing the rider to slide the board more easily. The hanger-side of the bushing is the part of the bushing that is twisted and compressed more when turning. It's significant that the baseplate half of the bushing is handling pressure from loads while the other half is handling the twisting forces from the hanger. This is significant because it keeps these two forces from interacting, providing a more consistent performance at a wider range of speeds. This truck could be described as a torsional truck because the bushing is twisted as opposed to compressed. This has been seen as a better way to deform the bushing because the bushing is pulled as opposed to pushed. Because of the before described interactions between all of the parts, this truck has significant performance advantages.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference and as far as they are consistent with the disclosure herein. The mere mentioning of the publications and patent applications does not necessarily constitute an admission that they are prior art to the instant application.

What is claimed is:

1. A truck comprising: (a) a baseplate for attaching the truck to a skateboard comprising a partial housing for a bushing having the shape of a polyhedron and a housing for a pivot kingpin assembly; (b) a hangar comprising a partial housing for a bushing having the shape of a polyhedron and an axle having ends that wheels can be affixed to; (c) a pivot kingpin assembly which fits into the housing for a pivot in the base-plate and the pivot having a cylindrical hole which the kingpin passes through; (d) a bushing having the shape of a polyhedron, a portion of which fits into the partial housing of the baseplate and a portion of which fits into the partial housing of the hangar and has a cylindrical hole through which the kingpin of the pivot kingpin assembly passes through attaching the hangar to the baseplate said truck having one or more of the following: (i) a baseplate with a partial housing for a bushing that is of a shape for partially housing a bushing having the shape of a polyhedron; (ii) wherein the baseplate has a housing for the pivot of the pivot kingpin assembly wherein the pivot has a shape of a cube or a rectangular cuboid and a cylindrical hole for housing the kingpin; a hangar with a non-circular partial housing for a bushing that is of a shape polyhedron; (iii) a non-circular bushing in the shape of a polyhedron; (iv) the pivot of the pivot kingpin assembly having a cylindrical hole through which the kingpin fits; (v) having the pivot is made of a semi-rigid elastic polymer; (vi) having a bushing that is a polyhedron having 2 or more filleted edges; and (vii) the kingpin of the pivot kingpin assembly and the corresponding features of the hangar and the baseplate are configured so that the axis of the kingpin is at an acute angle to the baseplate and a perpendicular angle to the axle of the hanger.

2. The non-circular bushing for the truck of claim 1 having a housing for a non-circular bushing wherein the non-circular bushing has (a) two or more faces that come into contact with two or more faces of a partial bushing housing of the hanger (b) two or more faces that come into contact with two or more faces of the partial baseplate housing of a truck and (c) a pivot kingpin assembly.

3. The non-circular bushing of claim 2 wherein the non-circular bushing has one or more of: the shape of a truncated triangular bipyramid; and the shape of a polyhedron and the polyhedron has two or more filleted edges.

4. The non-circular bushing of claim 2 which is made of a polyurethane elastomer.

5. The truck of claim 1 further comprising a pivot locker.

6. The truck of claim 1 wherein the angle of the axis of the kingpin to the baseplate is less than 80 degrees.

7. A skateboard having 2 trucks of claim 1.

8. The truck of claim 1 wherein the non-circular bushing is in the shape of a truncated triangular bipyramid; is made from elastomer; or wherein the pivot of the pivot kingpin assembly has a pivot body which is made from an elastomer.

9. A non-circular bushing having a shape of a bipyramid or a truncated bipyramid wherein the bipyramid or truncated bypyramid has two or more filleted edges and wherein the bushing is partially housed in a hangar and a baseplate.

10. The bushing of claim 9 which is made of an elastomer.

11. The bushing of claim 9 having a hole through the center to accommodate a pin or bolt.

12. The bushing of claim 9 further comprising a pivot.

13. A device having the bushing of claim 9.

14. A device having a bushing of claim 9 further comprising a housing or one or more partial housings for and a pivot kingpin assembly.

15. A device or skateboard truck having a bushing of claim 9 wherein the bushing system provides or improves one or more characteristics selected from damping, shock absorption, reduction in wear and/or tear of other parts, rebound, noise reduction or attenuation, lubrication elimination, isolation, or vibration reduction or isolation as compared to the traditional bushing system used in that device.

16. The bushing of claim 9 that is not in the shape of a regular cube or a rectangular parallelepiped.

* * * * *